US005535604A

United States Patent [19]

Rodrigues et al.

[11] Patent Number: 5,535,604

[45] Date of Patent: Jul. 16, 1996

[54] APPARATUS FOR ARTIFICIAL WEARING AND FADING OF TEXTILE MATERIALS

[76] Inventors: Antoine Rodrigues, Domaine de Barrau, 11620 Villemoustousou, France; Eric LeClerc, Rue du Bois-Mastrade, 33, B-1380 Lasne, Belgium

[21] Appl. No.: 278,053

[22] Filed: Jul. 20, 1994

[30] Foreign Application Priority Data

Jul. 20, 1993 [FR] France ..... 93 09142

[51] Int. Cl.[6] ..... D06B 3/10

[52] U.S. Cl. ..... 68/28; 68/142; 451/328

[58] Field of Search ..... 68/24, 28, 60, 68/142, 144; 451/328; 241/278.2, 300; 69/30; 34/602

[56] References Cited

U.S. PATENT DOCUMENTS

| | | | |
|---|---|---|---|
| 870,071 | 11/1907 | Wilson | 451/328 X |
| 1,034,712 | 8/1912 | Jablesnik | 451/328 X |
| 1,508,345 | 9/1924 | Lupo, Jr. | 451/328 |
| 2,807,020 | 9/1957 | Schell | 451/328 X |
| 2,970,783 | 2/1961 | Cheyette | 241/300 |
| 4,941,333 | 7/1990 | Blessing | 68/142 X |

FOREIGN PATENT DOCUMENTS

| | | | |
|---|---|---|---|
| 0288722A3 | 11/1988 | European Pat. Off. . | |
| 2514793 | 4/1983 | France . | |
| 3710723C1 | 9/1988 | Germany . | |
| 1229 | of 1865 | United Kingdom | 451/328 |

*Primary Examiner*—Philip R. Coe

*Attorney, Agent, or Firm*—D. Peter Hochberg; Mark Kusner; Michael Jaffe

[57] ABSTRACT

Apparatus which is able to artificially produce wearing and fading of textile materials including an enclosure which is a barrel (1). This barrel is able to be placed into rotation around an axis (5), the barrel having an opening (6) which is equipped with a watertight door (7). The interior partitions (2) of the barrel are equipped with an abrasive lining (3), which includes protruding particles (12) and a stratified layer of these pieces.

12 Claims, 1 Drawing Sheet

APPARATUS FOR ARTIFICIAL WEARING AND FADING OF TEXTILE MATERIALS

This invention involves a wearing mechanism or artificial aging process suitable for the textile industry, specifically the garment industry, particularly the ready-to-wear industry, more particularly where the clothing is made with tinted cloth.

One knows that clothing made with tinted tissue, like jeans, for example, have a relatively dark color and the cloth is usually thick and therefore not very flexible. These characteristics make the factories' clothing without additional treatment less attractive and less comfortable to wear.

Moreover, the current styles and consumer demand is oriented towards clothing with colors which are lighter, less austere which possess a "used" or "already worn" quality. In order to obtain these results rapidly,and by following an economical process, there is an apparatus which treats cloth according to the description which follows.

The clothing to be treated is placed into the barrel which rotates. The interior partitions are equipped with a shock absorbing rubber coating and bossages. Also included is a small amount of water and a specified quantity of pumice stones which serve as the abrasive function in the process of "wearing and tearing". The barrel, after having been closed, is put into rotation following a determined cycle, during which the load of clothing comes into contact with the pumice stones. Used according to a degree determined by the cycle of rotations, the bossages serve the role of keeping the clothing from wading up into balls.

Utilizing this method leads to respecting certain values with regard to the different quantities and different elements present, as well as the quality of the given product. It also limits the life of certain parts of the machine, especially the case lined with rubber which must be replaced frequently. The average load calls for 1 kg. of pumice stone per 1 kg. of clothing, which leads to the spewing out of about 100 kg. of pumice stone for 100 kg. of treated cloth.

The average duration of the treatment in these machines is about 105 mn. One could argue that the quantity of slut/spew is enormous, which could pose pollution problems. Moreover, the mixing of the pumice stones in the barrel makes a loud noise and is therefore bothersome for the operators working near the machines. One could also remark that the replacement of rubber-lined machinery would take several days during which the machine is immobilized and cannot be productive. These aformentioned criticisms present important inconveniences which are far from negligible.

This invention seeks to alleviate the inconveniences mentioned above and also provides other advantages which will be described in the paragraphs to follow.

More precisely, this invention has as its foundation an apparatus which would allow one to artificially obtain fading of textile products including at least an enclosure provided by the barrel which is set on rotation around an axis. This barrel has an opening included with a watertight door. The interior partitions of the barrel include an abrasive side, comprising protruding pieces.

An advantage of this invention is that the apparatus allows for repeated abrasion, performed by the protruding pieces, which are located inside the enclosure and eliminate the use of pumice stones due to the inconveniences linked to them such as the pollution, noise, mechanical aggravation of the machine, lack of space available for clothing due to the large quantity of pumice stones. Moreover, the addition of enzymes into the water allow the machine to function in a combined fading and wearing process.

The contact of the product to be treated with the abrasive lining wall is obtained by the rotation of the enclosure onto itself. This allows one to use the apparatus on industrial, rotating machines currently available in the textile industry. This characteristic also allows for the insertion of mobile abrasive elements into the enclosure. For example, if the pumice stone is in a small quantity, it would eventually reduce the treatment.

The combination of a binder with protruding pieces which form the abrasive lining which provides abrasive characteristics and a durable lining while they function according to the needs of the materials which make up the binder and the protruding particles. This combination gives a thickness and a weight to the flexible lining, as well as an appropriate geometric shape.

According to this advantage, the aforementioned abrasive coating lining forms a surface which is demarcated, almost entirely, by a straight line, laid perpendicular to the axis of rotation, and the generating interior enclosures. This characteristic makes the "wearing" more homogeneous.

According to another characteristic, the abrasive lining is put onto these interior walls in a way so that they can be dismantled. This is a great, practical feature which allows easy replacement of the abrasive lining, as well as its adaptation into the barrels of other conventional machines. However, the detachable, dismantleable nature of the lining is not a necessary function of the apparatus in this invention. One could just as well have an abrasive lining which was an integral part of the barrel.

Another advantageous characteristic comprising using one or several dismantleable bossages as a means of creating a rapid interchangeable possibility of the abrasive lining. Then there would be an appreciable diminuition of the delay of the machine's immobility, as well as a simpler construction.

Another characteristic of the apparatus called for in this invention includes the aforementioned abrasive lining, including:

- a stratified layer including a resin and some protruding pieces.
- a supplementary layer including a resin and some protruding pieces.

The advantage of this characteristic exists mainly in the achievement of a lining resistant to the strong mechanical constraints, which could as well form a supporting structure for the barrel when it is submitted to heavy loads by the products to be treated.

The advantageous characteristics of this lining consist of the aforementioned resin of polyester, or something similar this fibrous substance is made up of glass fiber, or something similar for example, carbon or kevlar the aforementioned protruding particles comprises abrasive pieces like sand from quartz stone.

According to another characteristic, the resin of polyester which contains a colloidal silica, is preaccelerated with an additive, usually cobalt octoate. The resin of polyester is catalyzed by a methylethylcetone peroxide concentrated in the aforesaid supplementary layer. According to another characteristic, the protruding abrasive particles have a concentration in the supplementary layer of approximately 10–12 kg per meter squared of abrasive lining, and a particle granule size of between 0–7 mm, preferably, around 3 mm.

Research of interest regarding these characteristics concentrates on the obtainment of an abrasive lining resistant to chemicals, such as enzymes, which are added to the fluid (i.e., water) in the barrel to chemically treat (e.g. fade) the textile products therein.

The number of advantages of this apparatus will stand out in the description which follows, as well as in the appended drawings.

Figure 1:
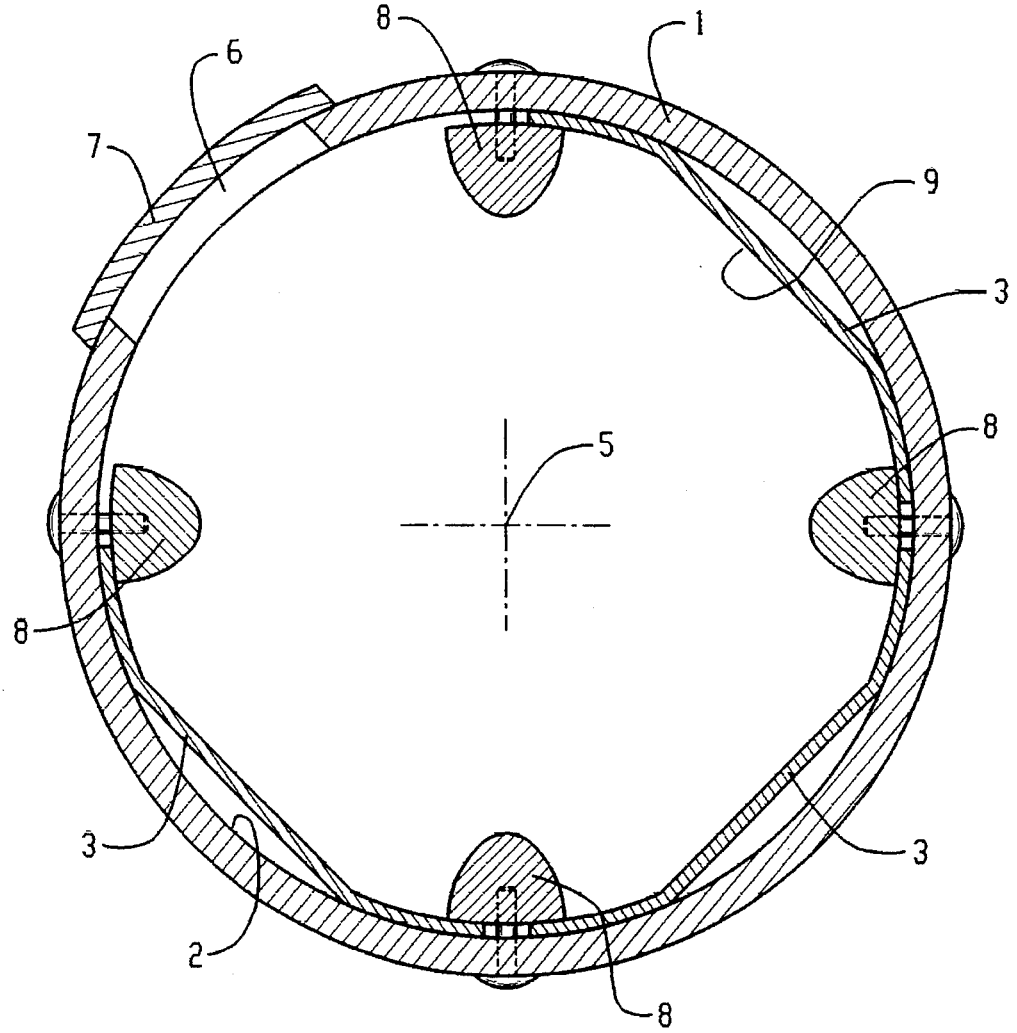
FIG. 1 represents an oversimplified cross-sectional view of the barrel according to this invention; where the interior partitions have bossages and an abrasive lining; where the barrel is designed to be mounted onto a rotating machine.

The apparatus shown in FIG. 1 consists of a rotating barrel (1) around an axis (5), equipped with an opening (6) which has a watertight door (7). The cylinder part of the drum's interior partitions (2) includes an abrasive lining (3) advantageously separated into 3 sections. This abrasive lining is defined by 4 bossages (8) of which the longitudinal axis is parallel to the generating cylinder interiors of the partitions (2), the bossages (8) having all known shapes, with greater thickness compared to that of the abrasive lining (3) and greater length, at least equal to the generating parts. These bossages are designed to prevent the cloth from wading up during the cycle of rotations. One of 4 intervals in the interior cylinder of the barrel (1) is defined by 2 bossages (8), and is not equipped with an abrasive lining (3). This space is located in the opening (6) for the padding of the barrel (1).

The 3-part abrasive lining (3) shown in FIG. 1, is advantageously fixed so that it is detachable from the interior partitions (2) of the barrel (1) half-way between the bossages (8), by the encasement between the interior cylinder partition (2) and the bossages (8); those which are fixed in a detachable manner in all ways known, for example, by the bolts, at the side of the barrel (1). This method of detachable fixation of the abrasive lining allows a rapid replacement when it is being used, by unscrewing the bolts. One can equally point out that the characteristic of the machine's rapid transformation on which it is mounted makes it adaptable even to a washing machine, simply by detaching the abrasive lining.

As FIG. 1 represents, there is again the abrasive lining (3) which forms some planes (9) between each pair of consecutive bossages (8) of which these surfaces are parallel to the axis of rotation (5) of the barrel (1) and defined by a line located perpendicular to the axis of rotation (5) following the two generating interior walls (2). The purpose of the planes (9) is to complete the function of the bossages (8) while limiting the turning of the clothes in the interior of the barrel during the cycle of rotations, in a homogenous way, to improve the efficiency of the abrasive lining (3).

Figure 2:
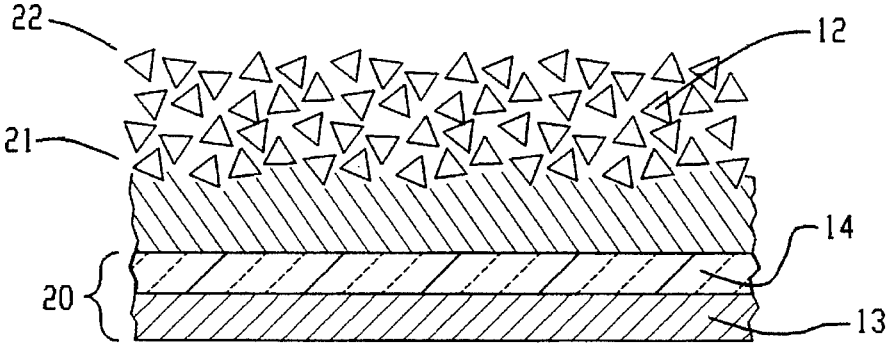
FIG. 2 represents a view of the thickness of the abrasive lining; made up of resin, protruding abrasive pieces; including a stratified section.

The example of the abrasive lining, shown in FIG. 2, includes in its overall structure, some abrasive particles (12), some of which are protruding, which are linked to the aforementioned particles. The abrasive lining has a stratified layer (20), including a resin of polyester (13) and a braid/plait of glass (14), a supplementary section, containing a resin of polyester (13) and some particles of sand or dry quartz (12).

The lining shown in FIG. 2, has at least one other layer (22) of resin (13), with the purpose of definitively expelling the abrasive pieces (12) on the surface.

The apparatus of wearing and fading according to the invention portrayed in FIG. 1 is put into production in the following way:

One places the load of clothing to be treated into the barrel (1) of which the internal walls (2) are equipped with an abrasive lining (3) which come easily into contact with the clothing in the barrel as it rotates. An opening (6), made for this purpose, is advantageously located in the cylinder partition of the barrel.

One puts into the barrel (1), through the opening (6), a quantity of water which is two times heavier than the load of clothing. One can also add a substance such as enzymes in the case where one wants to obtain an overall fading of the clothing, especially for certain clothing like jeans. This operation is complementary to the wearing treatment.

After the shutting of the watertight door (7), the barrel is put into rotation according to a cycle determined by the degree of wearing desired, as well as the product that one wants to obtain. One will notice that no mobile abrasive device is used in the barrel, like pumice stone, for example.

Once the cycle of rotations is achieved, one empties the barrel (1) and takes out the load of treated clothing.

The apparatus can be realized with industrial applications widely known, especially those concerning the fabrication of plastics, in particular layered; for this is the example of the abrasive lining according to this invention, especially those rotating machines with barrels frequently used in industry, notably in the conventional wearing treatments of textile products that use cloth with pumice stone.

We claim:

1. An apparatus for artificially wearing and fading textile products comprising:

a generally cylindrical rotatable housing defining an inner chamber, said housing having an inner surface and a sealable opening for accessing said inner chamber;

at least one abrasive lining member attached to said inner surface and having a planar portion spaced inward from said inner surface.

2. An apparatus according to claim 1, wherein said abrasive lining member is comprised of protruding particles and a binder for binding said protruding particles.

3. An apparatus according to claim 1, wherein said abrasive lining member is detachable from said inner surface.

4. An apparatus according to claim 3, wherein said detachable abrasive lining member is attached to said inner surface by a detachable bossage means.

5. An apparatus according to claim 1, wherein said abrasive lining member is comprised of:

a stratified layer including a first resin and a fibrous substance; and a supplementary layer including a second resin and protruding pieces.

6. An apparatus according to claim 5, wherein said first and second resin are a resin of polyester.

7. An apparatus according to claim 6 wherein said resin of polyester includes colloidal silica, said resin of polyester preaccelerated with cobalt octoate and catalyzed with methylethylcetone peroxide.

8. An apparatus according to claim 5, wherein said fibrous substance is comprised of at least one of the following: glass fibers, carbon and kevlar.

9. An apparatus according to claim 5, wherein said protruding pieces are comprised of abrasive particles.

10. An apparatus according to claim 9, wherein said abrasive particles include sand from quartz stone.

11. An apparatus according to claim 10, wherein said abrasive particles in the supplementary layer have a concentration of approximately 10 to 12 kg per square meter of said abrasive lining member, and a particle granule size of between 0 and 7 mm.

12. An apparatus according to claim 1, wherein said apparatus is comprised of three of said abrasive lining members, each said abrasive lining member having a planar portion being perpendicular to a planar portion of at least one of said other abrasive lining members.

* * * * *